US011447320B2

(12) United States Patent
Buse

(10) Patent No.: US 11,447,320 B2
(45) Date of Patent: Sep. 20, 2022

(54) PACK FOR CIGARETTES AND METHOD AND APPARATUS FOR PRODUCING SAID PACK

(71) Applicant: Focke & Co. (GmbH & Co. KG), Verden (DE)

(72) Inventor: Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 273 days.

(21) Appl. No.: 16/359,169

(22) Filed: Mar. 20, 2019

(65) Prior Publication Data

US 2019/0218021 A1 Jul. 18, 2019

Related U.S. Application Data

(63) Continuation-in-part of application No. 15/777,794, filed as application No. PCT/EP2016/001819 on Nov. 2, 2016, now Pat. No. 10,766,688.

(30) Foreign Application Priority Data

Dec. 10, 2015 (DE) ..... 102015016043.5
Feb. 5, 2016 (DE) ..... 102016001297.8

(51) Int. Cl.
*B65D 85/10* (2006.01)
*B65D 75/58* (2006.01)
*B65B 19/02* (2006.01)

(52) U.S. Cl.
CPC ..... *B65D 75/5838* (2013.01); *B65B 19/025* (2013.01); *B65D 75/5855* (2013.01);
(Continued)

(58) Field of Classification Search
CPC ..... B65D 85/1045; B65D 85/1027; B65D 85/1018; B65D 75/5838; B65D 2575/586; A24F 15/12
See application file for complete search history.

(56) References Cited

U.S. PATENT DOCUMENTS 4,420,080 A 12/1983 Nakamura
2011/0226640 A1 9/2011 Bertuzzi
2018/0354695 A1* 12/2018 Bourgoin ..... B65D 85/1027

FOREIGN PATENT DOCUMENTS

CN 1123760 A 6/1996
CN 1939710 A 4/2007
(Continued)

OTHER PUBLICATIONS

China National Intellectual Property Administration, Notification of the First Office Action (in a related application), dated Apr. 28, 2019.

(Continued)

*Primary Examiner* — Mollie Impink
(74) *Attorney, Agent, or Firm* — Laurence P. Colton; Smith Tempel Blaha LLC

(57) ABSTRACT

A cigarette pack in the form of a sealing pack consisting of an inner pack and an outer pack in the form of a hinge-lid box. An opening aid of the inner pack is provided with a removal opening which is formed as an open recess as a result of punching during the production of a blank for the inner pack, in particular in the region of a continuous material web. Said removal opening, which is free right from the start, is closed by a closure tab which is able to be opened and closed multiple times on account of a corresponding glue connection. The closure tab is preferably connected permanently to the inside of a lid front wall of the outer pack by means of an actuating tab.

6 Claims, 12 Drawing Sheets

(52) U.S. Cl.
CPC ... *B65D 85/1027* (2013.01); *B65D 85/10568* (2020.05); *B65D 2575/586* (2013.01)

(56) References Cited

FOREIGN PATENT DOCUMENTS

| | | | | | |
|---|---|---|---|---|---|
| CN | 104114465 | A | | 10/2014 | |
| DE | 4041743 | A1 | | 6/1992 | |
| DE | 202004000278 | U1 | | 4/2004 | |
| DE | 102010019867 | A1 | | 9/2011 | |
| DE | 102013011502 | A1 | | 1/2014 | |
| EP | 0691267 | A1 | | 1/1996 | |
| EP | 1770015 | A2 | | 4/2007 | |
| GB | 2520992 | A | * | 6/2015 | ..... B65D 75/5838 |
| JP | 2008502555 | A | | 1/2008 | |
| JP | 2013521198 | A | | 6/2013 | |
| JP | 2014514992 | A | | 6/2014 | |
| WO | 02079051 | A1 | | 10/2002 | |
| WO | 2013120913 | A1 | | 8/2013 | |
| WO | 2014195016 | A1 | | 12/2014 | |
| WO | 2015132768 | A1 | | 9/2015 | |
| WO | 2016087829 | A1 | | 6/2016 | |
| WO | WO-2017002002 | A1 | * | 1/2017 | ..... B65D 75/5855 |
| WO | 2017097388 | A1 | | 6/2017 | |

OTHER PUBLICATIONS

WIPO, International Search Report (on parent application), dated Jan. 2, 2017.

Deutsches Patent Und-Markenamt (German Patent and Trademark Office), Recherchenbericht (search in connection with related application), dated Aug. 3, 2016.

* cited by examiner

PACK FOR CIGARETTES AND METHOD AND APPARATUS FOR PRODUCING SAID PACK

CROSS-REFERENCE TO RELATED APPLICATIONS

This application is a continuation-in-part of U.S. patent application Ser. No. 15/777,794 having a filing date of 21 May 2018, which is the US PCT National Phase of International Application No. PCT/EP2016/001819 having an International Filing Date of 2 Nov. 2016, which claims priority on German Patent Application No. 10 2015 016 043.5 having a filing date of 10 Dec. 2015 and German Patent Application No. 10 2016 001 297.8 having a filing date of 5 Feb. 2016.

BACKGROUND OF THE INVENTION

Technical Field

The invention relates to packs for cigarettes or other smoking articles having an outer pack, preferably in the form of a hinge-lid box/hinge-lid pack with a box part and lid, as well as having an inner pack in the form of a blank of material that surrounds a cigarette group preferably on all sides, wherein the inner pack comprises an opening aid, preferably in the end-face region of an inner front wall of the inner pack and at least in a part region of an inner end wall, wherein the opening aid comprises a closure means, such as a closure tab, which is preferably arranged on the outside of the inner pack and is fastened on the inner pack by means of releasable adhesion and for opening the inner pack is pulled at least in part away from the inner pack and, as a result, exposes a removal opening at least in part.

Prior Art

Sealing packs for cigarettes consist of a foil block or sealing block as the inner pack and an outer pack, in particular in the realization as a hinge-lid box. The sealing block is provided with an opening aid where a re-usable closure tab, which is fixed by means of suitable adhesive, is able to be moved into the open position and then back into the closed position again as a result of pulling. A removal opening in the foil block is exposed in the open position.

Packs where the closure tab is fixed with an actuating lug on the inside of a lid—lid front wall—of a hinge-lid box have also already been disclosed. When the lid of the outer pack is opened, the closure tab is (automatically) accordingly entrained into the open position. When the lid is closed, this also creates the closed position (WO 2013/120913).

BRIEF SUMMARY OF THE INVENTION

It is an object of the invention to develop further and to improve the technology with regard to the design, the functionality, and the production of sealing packs for cigarettes, in particular with regard to the structure of the opening aid.

To achieve said object, the pack according to the invention is a pack for cigarettes or other smoking articles having an outer pack, preferably in the form of a hinge-lid box/hinge-lid pack with a box part and lid, as well as having an inner pack in the form of a blank of material that surrounds a cigarette group preferably on all sides, wherein the inner pack comprises an opening aid, preferably in the end-face region of an inner front wall of the inner pack and at least in a part region of an inner end wall, wherein the opening aid comprises a closure means, such as a closure tab, which is preferably arranged on the outside of the inner pack and is fastened on the inner pack by means of releasable adhesion and for opening the inner pack is pulled at least in part away from said inner pack and, as a result, exposes a removal opening at least in part, characterized by the following features:

a) the inner pack is provided with a free opening—removal opening—which is produced during the production process;
b) the closure tab covers the opening completely and on all sides in the closed position, preferably with an overlapping edge or overlapping strip which extends all around;
c) the closure tab is free of adhesives in the region of the opening; and
d) the closure tab comprises a glue-free actuating tab preferably in the region of the inner front wall.

In exemplary embodiments, the inner pack can be in the form of a foil block made from a foil material, a cardboard block made from a cardboard material, or a layered block made from at least one layer of foil and at least one layer of cardboard.

A characteristic of the innovation accordingly consists in that the removal opening is not generated the first time the pack is opened by removing an opening piece or an opening tab of the inner pack. Rather, the inner pack is provided with a prefabricated removal opening. Said removal opening is preferably provided in the region of a (continuous) material web for the production of blanks for the inner pack, as a result of cutting or punching in a position which corresponds to the position in the pack.

The opening or removal opening is covered (completely) by a closure tab. Overlapping edges are by means of permanent adhesive, preferably pressure sensitive adhesives (PSA adhesive) is connected to an edge of the material which surrounds the opening. The closure tab is preferably also provided in the correct position in the region of the material web, as an alternative to this prior to or after the production of the (removal) opening. A method where the closure tab is initially provided in the correct pack position on the material web and an opening which forms the removal opening of the pack is then produced as a result of punching or by laser in the region of the closure tab is particularly advantageous.

According to a further embodiment of the invention, the opening aid for the inner pack or sealing block is integrated into the (laminate) material which consists of at least two layers or individual types of materials, such as at least two layers of foils, at least two layers of cardboard, or at least one layer each of foil and cardboard. From the layers of materials connected together predominantly all over (by glue), one layer or individual layer of material (on the outside of the inner pack) forms a closure tab, the other (inside) layer or individual layer of material forms the removal opening. An opening tab, which, when the opening aid is actuated, is moved into an open position on account of the connection to the closure tab of the other individual layer of material and thus creates or exposes the removal opening, is formed, in particular, as a result of corresponding punching in the region of the inner layer or individual layer of material. A characteristic in the case of said realization is the selected positioning of glue fields, in particular in a U-shaped surface structure, for the (releasable) connection of elements of the opening aid to one another.

A further embodiment consists in that preparations are made for an opening aid of the inner pack during the production of the blanks, in particular during the production of the continuous two-layered or multi-layered material of the inner pack in the region of each blank to be produced. In this case, structured glue patterns produced from multiuse adhesive, in particular PSA adhesive, are applied to the individual layer of material in the region of a removal opening for the releasable fixing of the closure tab, which is formed by the outer layer or individual layer of material. A or the inside individual layer of material of the laminate material is preferably provided with an, in particular, U-shaped tear line or continuous punching for defining an opening tab, which is provided with the surface adhesive for connecting the layers of the material or is connected to the outer layer and is thus connected to a part region of the closure tab.

A further characteristic of the opening aid consists in that an end-side or edge-side gripping tab or actuating tab, which preferably extends over the full width of the closure tab, is realized free of adhesive and preferably with a single layer. The actuating tab is fixed to the inside of a lid front wall of a hinge-lid box in particular by means of a glue connection such that when the lid is opened the closure tab moves into an open position.

The method and apparatus serve for providing opening aids of varying realization on a continuous web or on a multi-layered web. The innovative characteristic consists in that during the production process the (removal) opening is produced or exposed in the region of the continuous material web for forming the inner pack. The web is scanned by suitable (optoelectronic) sensors which are capable of checking the presence of the opening, the correct realization and positioning thereof. Particularly important is the action of an (opto-electronic) sensor in the region of the material web following the provision of the closure tab and of the (removal) opening, the sensor being arranged on the inside of the web and detecting the presence of the closure tab in a precise manner in the region of the opening as a result of colored and/or graphic contrasts between the free surface of the closure tab (in the region of the opening) and the surrounding material.

In addition, the closure tabs, which are preferably provided with glue (PSA glue), are provided in the region of the openings (to be produced subsequently) on the web. Sensors, which are assigned to suitable positions on the web, also check the correct positioning of the closure tabs.

Finally, complete, machinable blanks are separated from the web, the removal opening and the closure tab being most assuredly positioned in the correct place.

BRIEF DESCRIPTION OF THE DRAWINGS

Exemplary embodiments of the packs, of pack material, and of the method and apparatuses are explained in more detail below by way of the drawings, in which.

DETAILED DESCRIPTION OF PREFERRED EMBODIMENTS

Figure 2:
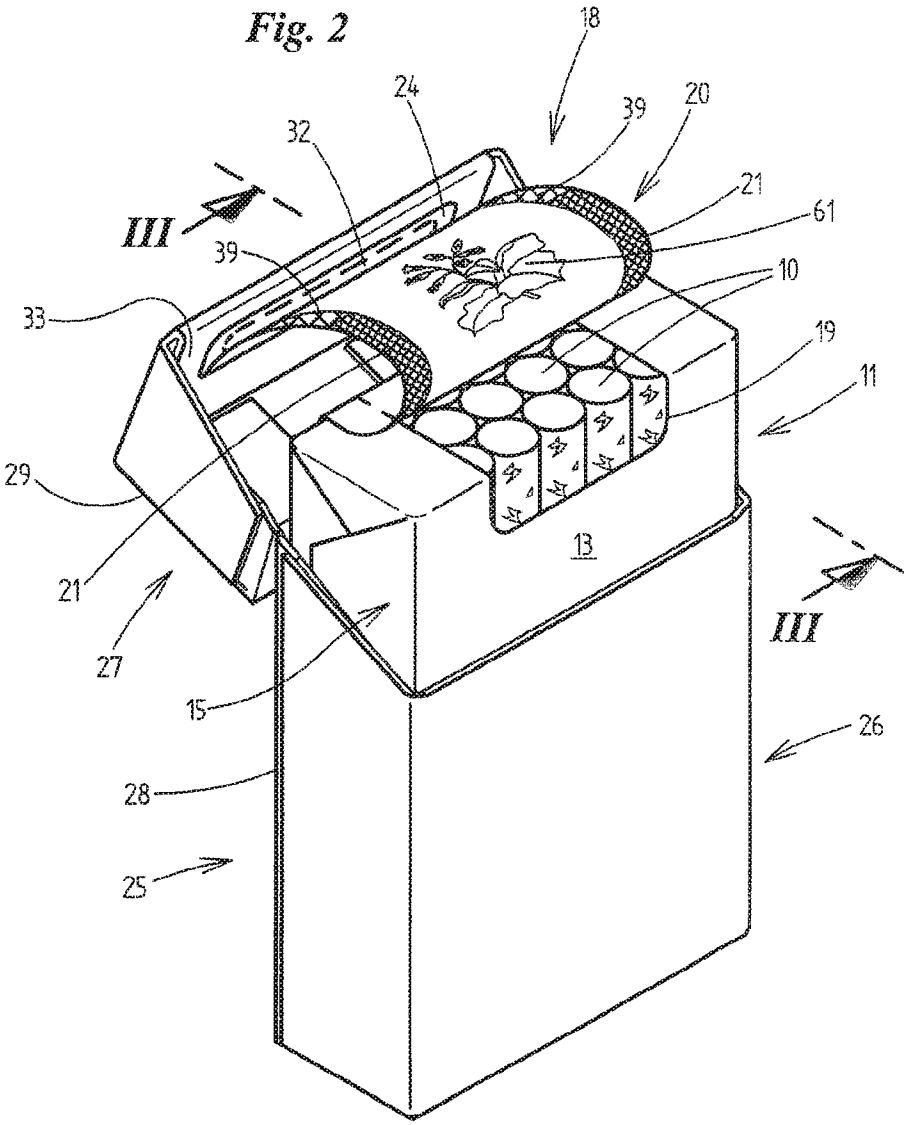

The exemplary embodiments of the drawings are concerned with the design of packs for cigarettes 10. A formed cigarette group, which consists namely of (multiple) rows, is the contents of an inner pack 11. Said inner pack 11 preferably consists of a blank 12 of material, such as a moisture-proof and aroma-proof foil, a moisture-proof and aroma-proof cardboard, other cardboard, layered or laminated materials having both foil and cardboard, and other materials suitable for use as an inner pack for cigarettes. The group of cigarettes 10 is preferably completely wrapped around, i.e. on all sides, by the blank 12, and consequently forms a sealing block with an inner front wall 13, inner rear wall 14, inner side walls 15, inner bottom wall 16, and inner end wall 17. The blank 12 is realized or is folded around the group of cigarettes 10 in such a way that the inner end wall 17 is free of folds, that is to say forms a continuously closed wall. An opening aid 18, which enables easy, in particular automatic access to the pack contents, is provided in said region. The inner pack 11 forms a removal opening 19 in the end-side region for this purpose. The removal opening 19 preferably extends in the region of the inner end wall 17 and in a connecting, end-side part piece of the inner front wall 13. The removal opening 19 is preferably arranged centrally, with a (clearly) smaller width than the inner pack 11.

The removal opening 19—with the pack closed—is covered by a closure means, in particular a closure tab 20. Said closure tab covers the removal opening 19 preferably completely and preferably forms a strip-shaped protrusion all around with longitudinal strips 21 and transverse strips 22.

An anchoring strip 23 is permanently connected to the inner pack 11, in particular as a leg of the closure tab 20 in the region of the inner rear wall 14. The aforementioned edge strips 21, 22, 23 are connected to the inner pack 11 as a result of bonding, in each case in an edge strip surrounding the removal opening 19. At least the longitudinal strips 21 and the transverse strips 22 are fixed with removable and re-usable adhesive, in particular PSA adhesive.

The closure tab 20 is provided in an end region, namely in the region of a leg which projects into the inner front wall 13, with a gripping or actuating tab 24. Said tab is glue-free at least on the side facing the inner front wall 13 and can be gripped as a result. The actuating tab 24 preferably extends over the full width of the closure tab 20 as an edge strip of the same.

A characteristic consists in that the actuating tab 24 in the case of the exemplary embodiments shown is connected to a movable part of an outer pack 25. The outer pack here is a hinge-lid box with a box part 26 and a lid 27. It is connected to the box part 26 so as to be pivotable via a line joint 30 in the region of a box rear wall 28 with a lid rear wall 29.

Figure 4:
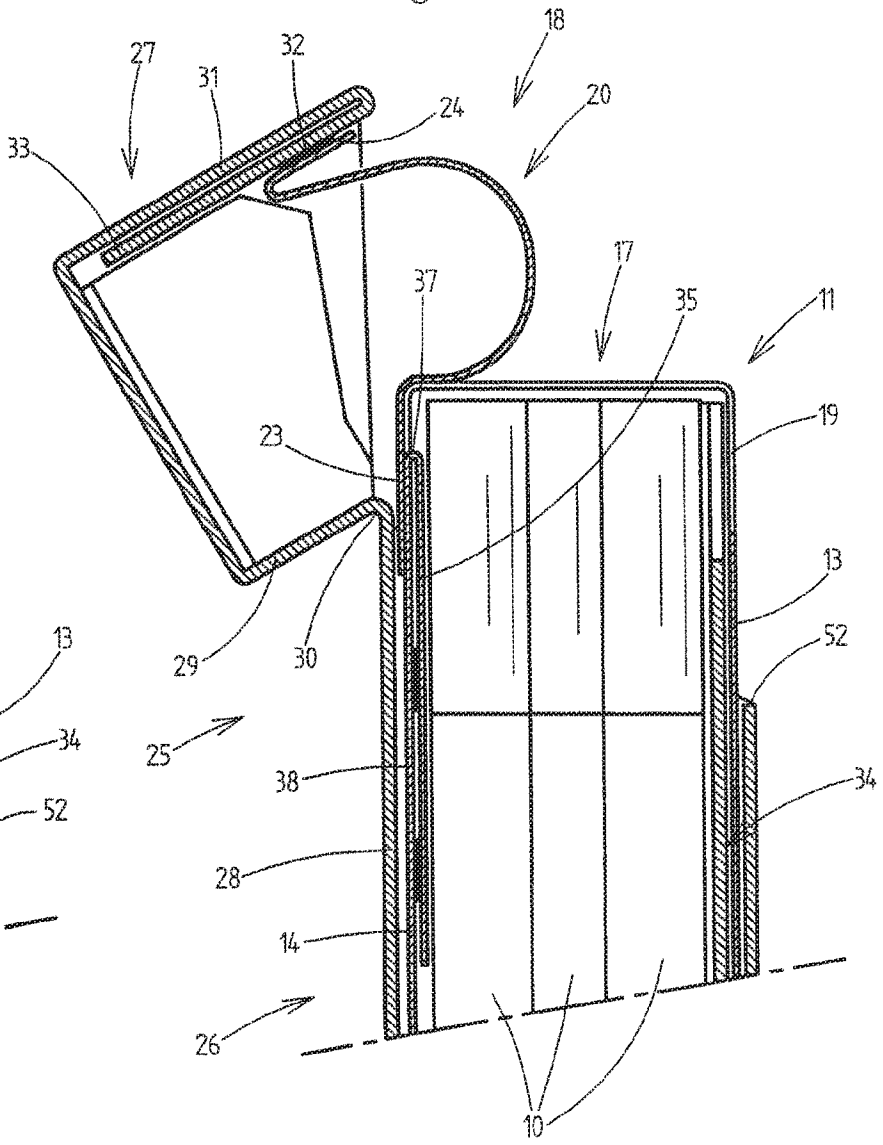
FIG. 4 shows a representation analogous to FIG. 3 for another exemplary embodiment.
Figure 3:
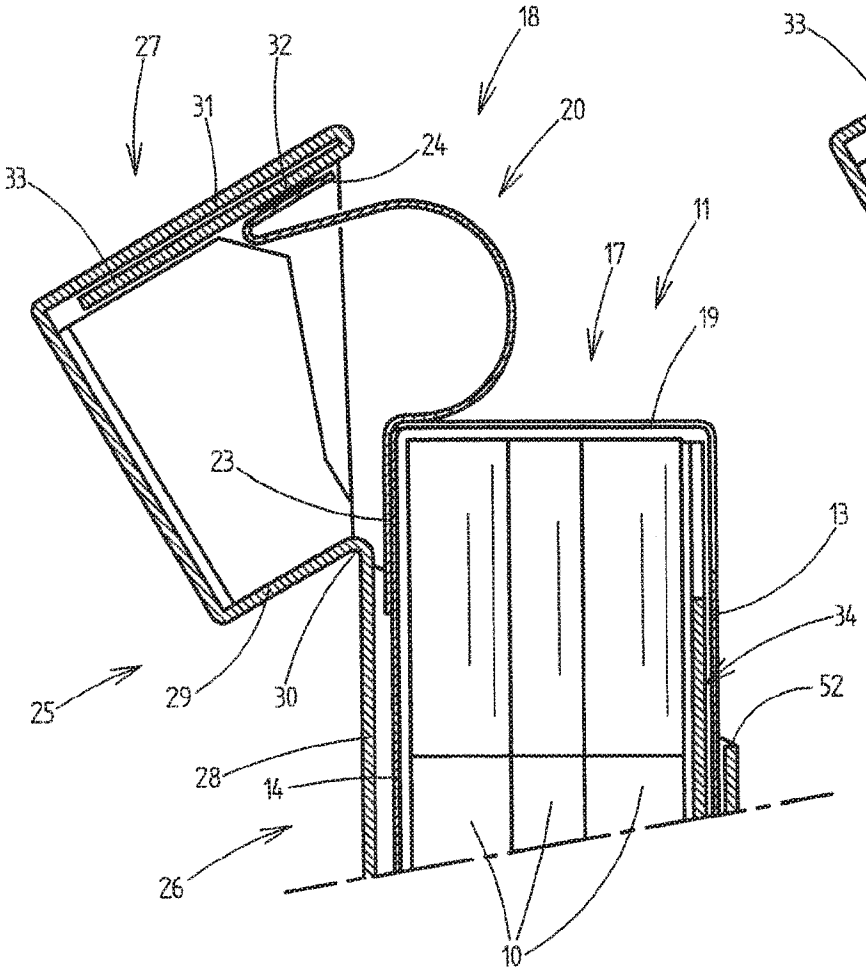
FIG. 3 shows a vertical section III-III of an end-side part region of the pack according to FIG. 2, in an enlarged scale.

The closure tab 20 is connected to the lid 27 in such a manner that when the same is opened, the closure tab 20 also moves into the open position (FIG. 3, FIG. 4). For this purpose, the actuating tab 24 of the closure tab 20 is connected to the lid, namely to a lid front wall 31. In particular, by means of glue or by means of a glue strip 32 which extends in the longitudinal direction of the actuating tab 24. Said glue strip is applied on the outside of the actuating tab 24. The connection to the actuating tab 24 by means of the glue strip 32 is produced during the production of the pack or when the inner pack 11 is inserted into the outer pack 25, with the lid 27 in the closed position. A lid inner tab 33 is preferably provided on the inside of the lid front wall 31. The actuating tab 24 is (permanently) connected to said lid inner tab. When the lid 27 is closed, the closure tab 20 also returns into the closed position (FIG. 1).

Figure 1:
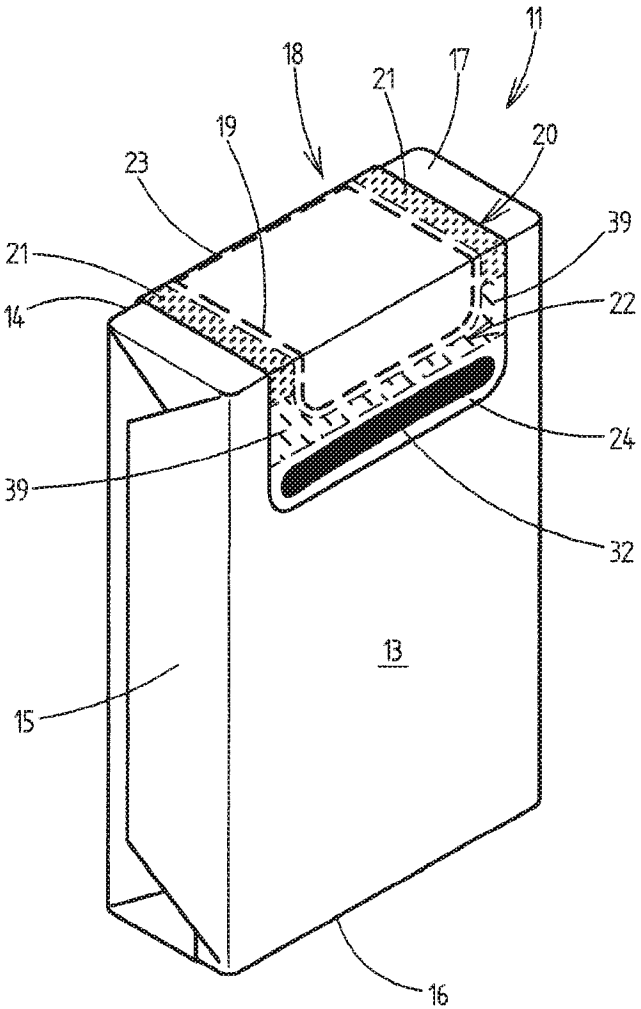
FIG. 1 shows a perspective representation of an inner pack or a sealing block with cigarettes, FIG. 2 also shows a perspective representation of a complete (cigarette) pack in the open position.

The inner pack 11 is preferably realized as a sealing block, according to FIG. 1 with a cover fold in the region of the inner side walls 15. Fold tabs which cover one another, preferably as a cover fold, are also formed in the region of the bottom wall 16. The fold tabs are tightly connected together as a result of thermal sealing. A support member, in particular a tray 34 in a known realization, preferably with a front wall, side lugs and a bottom wall, is additionally arranged inside the inner pack 11.

A characteristic consists in that the removal opening 19 is free at least in part, that is to say without the opening lugs 35 located in the region of the removal opening 19 during the preparation of the blank 12. It is part of the material in the region of the removal opening 19. In the case of the exemplary embodiment according to FIG. 1 to FIG. 3, the opening lug 35 has been completely removed. The blank is accordingly provided with a recess which forms the removal opening 19 in the case of the finished inner pack 11. For this purpose, in the region of the unfolded blank, preferably in the region of a continuous material web 36 for producing the blanks 12, a punching process is performed aligned precisely to the design of the inner pack 11, in the case of the exemplary embodiment in FIGS. 1 to 3 an all-around closed punching process which results in a substantially rectangular recess corresponding to the removal opening 19, in particular with edges which converge slightly—to the actuating tab 24. The opening lug 35 accordingly occurs as a blank part and is removed.

As an alternative to this (FIG. 4, FIG. 5, FIG. 6), U-shaped punching is applied in the blank 12 or the material web 36 for forming an opening. The generated opening lug 35 remains connected to the blank 12 along an edge 37. Here, the opening lug 35 is folded out of the region of the removal opening 19 and is placed against a wall of the inner pack 11, in the present case (FIG. 4, FIG. 5) against the inside of the inner rear wall 14. A free opening is also accordingly formed here too as a removal opening 19. The opening lug 35 is preferably connected to the wall of the inner pack 11, in particular as a result of adhesion and/or as a result of thermal sealing, in the present case with two sealing strips 38.

An (independent) characteristic is the realization of the glue regions or of the glue pattern for the (releasable) connection between the closure tab 20 and the inner pack 11. As can be seen in particular in FIG. 5, the closure tab 20 is provided with a glue pattern which is realized in a frame-like manner and surrounds the removal opening 19. It can be applied to the closure tab 20 (which consists of a separate blank) and/or to the blank 12 during production The glue pattern (preferably PSA adhesive), in particular with longitudinal strips 21, transverse strips 22 and anchoring strips 23, is realized with different degrees of bond, corresponding to the stress when the inner pack 11 is opened and closed. Preferably at least the transverse strip 22 is realized with a lesser degree of bond than the remaining portions of the glue pattern. In the present case, initial legs 39 of the longitudinal strips 21 are also realized with a lesser degree of bond such that, in particular, the introduction of the opening operation for the closure tab 20 is made easier. The further parts of the glue pattern, namely the longitudinal strips 21 and the transverse strips 22, are realized with a greater bonding force, preferably consistently with the same bonding force. As an alternative to this, the anchoring strip 23 can be realized with an even greater bonding force in order to ensure the permanent fixing of the opening tab 20 on the inner pack 11.

The various bonding and connecting effects of the regions of the glue pattern can be brought about by the corresponding selection of different glue types and/or can be achieved by different layer thicknesses and/or by different structures of the transverse strip 22 on the one hand and of the longitudinal strips 21 on the other hand.

Said design of the glue connection between the closure tab 20 and the inner pack 11 can also be applied in the case of conventional (sealing) packs and in the case of packs corresponding to FIG. 11 to FIG. 14. The conventional packs mentioned can be such where the opening lug 35 remains in the initial position and is connected to the closure tab 20.

Figure 5:
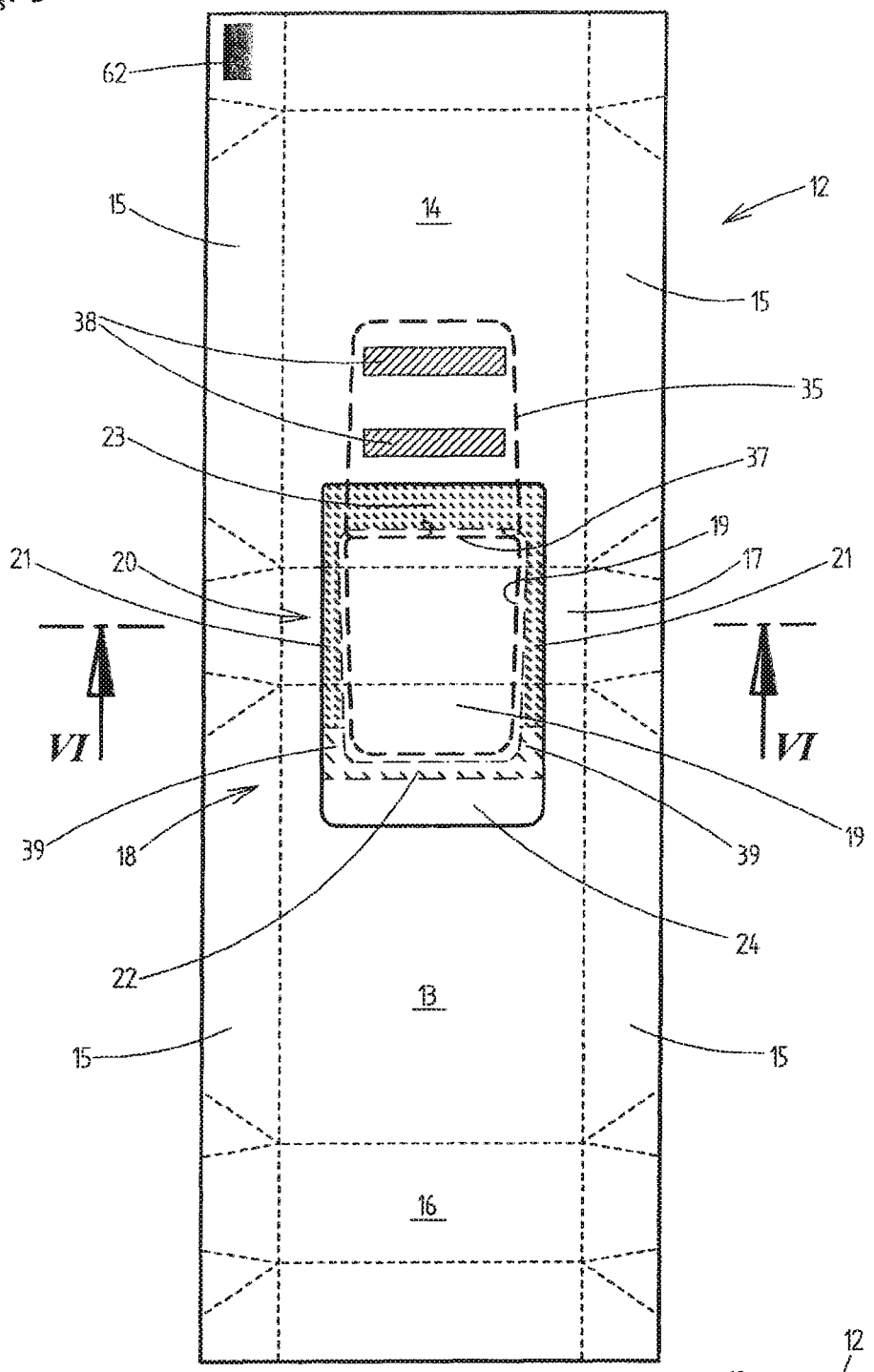
FIG. 5 shows a spread-out blank for an inner pack according to FIG. 1 in the realization according to FIG. 4.
Figure 6:
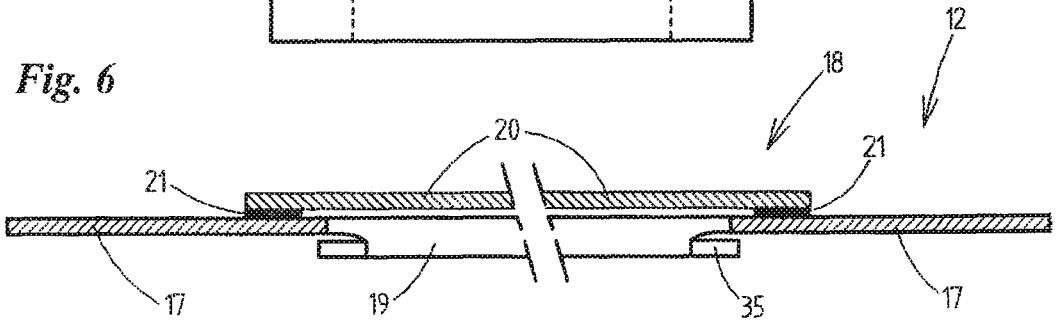
FIG. 6 shows a cross section VI-VI of the blank in FIG. 5, in an enlarged scale.

In the case of the inner pack 11 according to FIG. 1, FIG. 2 and the blank 12 matching hereto according to FIG. 5, the inner side walls 15 are formed by trapezoidal fold lugs. FIG. 7 to FIG. 10 are concerned with an alternative with regard to the realization of the opening aid 18, but also with regard to the realization of the inner pack 11. In the region of the inner side walls 15, the inner pack 11 comprises connection seams in the realization as fin seams. In addition, the inner bottom wall 16 here is free of folds. A transverse seam 40 is situated in the region of an inner rear wall 14, in particular in the realization as a fin seam.

The opening aid 18 is realized in the case of said exemplary embodiment such that the blank 12 (FIG. 9) receives a removal opening 19 that is free all around. Complete punching is accordingly applied—in the region of the material web 36—thereby generating a (removal) opening 19. The opening lug 35 generated in this case is disposed of as a waste piece. A free opening remains, in particular with opening edges which converge to the side of the actuating tab 24.

In the case of exemplary embodiments with a closure tab 20 produced from a separate blank, the (PSA) adhesive is preferably applied on the inside of the closure tab 20. A glue pattern in the realization of a closed frame is preferably created with the legs or strips 21, 22, 23. A central region of the closure tab 20 is glue-free and preferably provided with printing 61. The glue fields or glue strips are slightly offset in relation to the (removal) opening 19 such that a narrow, glue-free strip is preferably generated all around, with a width of approximately 1.5 mm.

The glue patterns are applied in the region of a glue-free part of the closure tab 20, namely in the region of the actuating tab 24, for connecting the actuating tab 24 to the inside of the lid front wall 31. Two alternatives are shown: a closed, continuous glue strip 32 can be applied. An alternative to this is a number of glue dots 41 located side by side.

Figure 12:
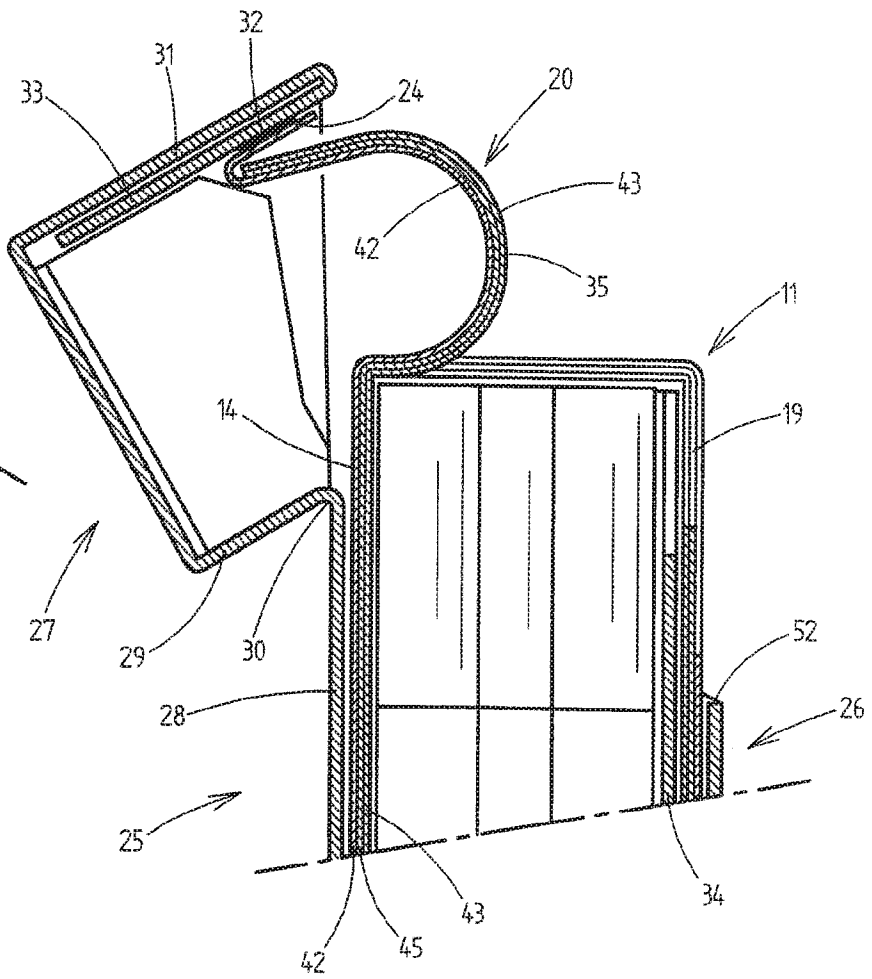
FIG. 12 shows a vertical section of a lid-side region of the pack according to FIG. 11 in the cutting plane XII-XII in an enlarged scale.
Figure 11:
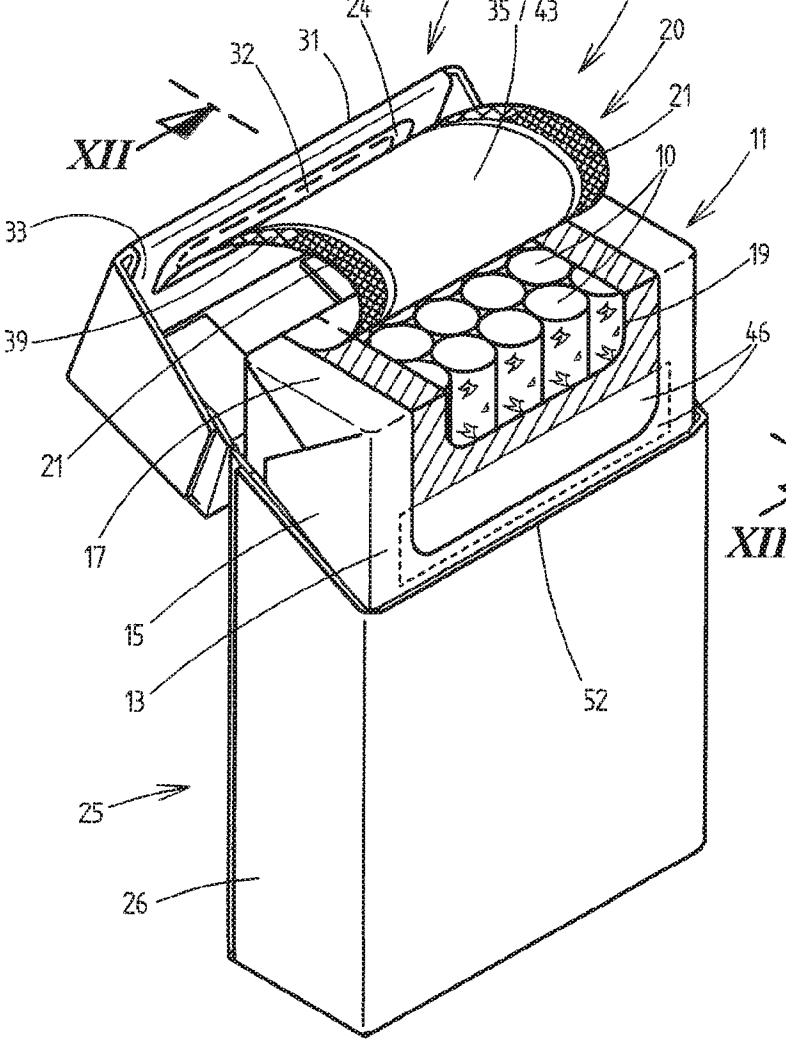
FIG. 11 shows a perspective representation of a further embodiment of a (cigarette) pack with the lid of an outer pack open.
Figure 13:
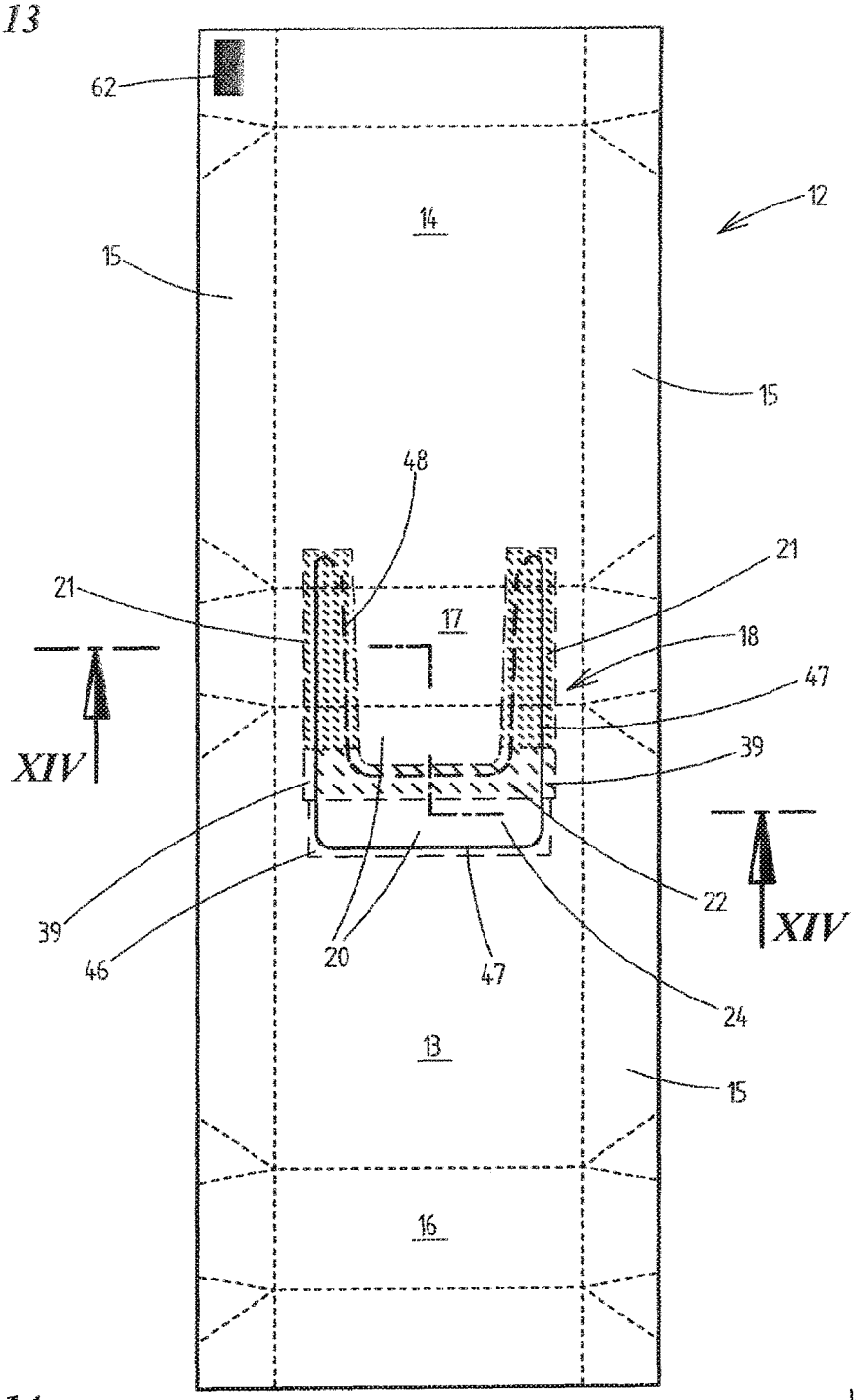
FIG. 13 shows a blank for an inner pack or a sealing block in the realization according to FIG. 11, FIG. 12.
Figure 14:
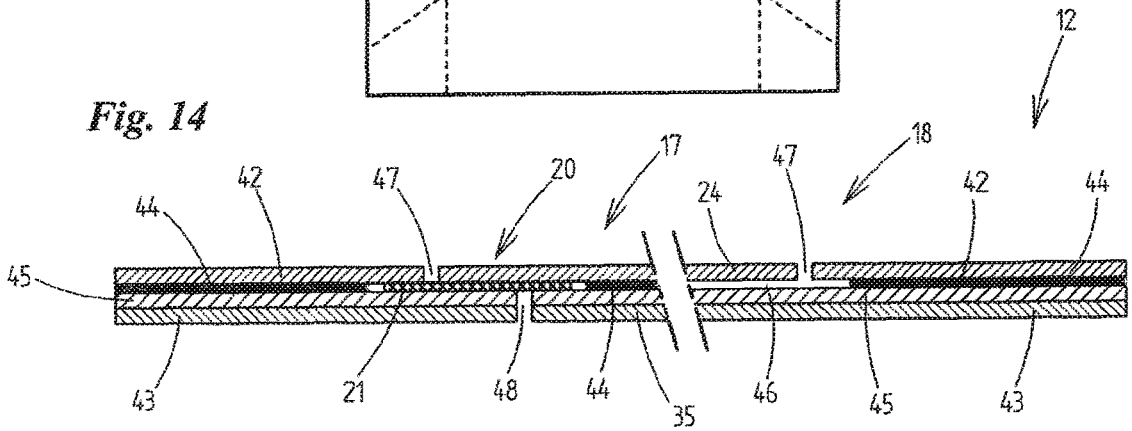
FIG. 14 shows a cross section XIV-XIV through the blank according to FIG. 13 in an enlarged scale.

A particular realization with regard to the sealing block or inner pack 11 and in particular in the region of the opening aid 18 is shown in FIG. 11 to FIG. 13. The material for the inner pack 11 is realized with multiple layers, it consists in particular of two layers or individual layers of material 42 and 43 (FIG. 14). Said layers or individual layers of material 42, 43 are connected together—predominantly—all over by a glue layer 44 produced preferably from non-releasable glue such that the individual layers of material 42, 43 form a non-detachable material unit in said region.

At least one of the individual layers of material 42, 43, in the present case the inside individual layer of material 43, is preferably realized as aroma-proof and moisture-proof, preferably as a result of a barrier layer 45. Here said barrier layer 45 lies inside the multi-layered material. The glue layer 44 accordingly connects the individual layers of material 42, 43 in the region of the barrier layer 45. Exemplary embodiments of the barrier layer 45 may be a metal or metal-based foil, a metal or metalized material that is applied by metallization, plastics or other polymers, waxes, paraffins, and/or other aroma-proof and/or moisture-proof materials.

The multi-layered material realized in the described manner can be provided with an opening aid 18 which corresponds to the previous exemplary embodiments. The structure of the material, however, enables an opening aid 18 which is realized in a specific manner and is integrated into the material thereby utilizing the individual layers of material 42, 43.

The closure tab 20 is formed by the outside individual layer of material 42. The inside individual layer of material 43 is processed such that it forms either an opening, which is provided during production, as a removal opening 19 or an opening tab or an opening lug 35 which is detachable by means of the closure tab 20 during the opening operation. It is connected to the closure tab 20, as shown preferably by full-surface bonding (on the inside).

The opening aid 18 in the case of said pack is produced in the region of the blank 12 (FIG. 13), preferably, however, during production of the (multi-layered) material—material web 36—by the targeted application of different glue types, by forming glue-free regions between the individual layers of material 42, 43 and by the targeted application of cutting lines in the individual layers of material 42, 43.

The provision of the opening aid 18 is integrated into the production process of the material or of the material web 36. When the layers or individual layers of material 42, 43 are joined together, surfaces which are necessary to the functionality of the opening aid 18 are preferably left out or are provided with glue at the same time or in an offset manner. In the case of the present example, a preferably U-shaped surface between the individual layers of material 42, 43 is provided with releasable glue (PSA adhesive), analogously to the described exemplary embodiment for forming longitudinal strips 21 and transverse strips 22. As an alternative to this, a part or full coating with glue can be applied. In addition, with regard to the application of the glue layer 44, a—strip-shaped, rectangular—free zone 46 is created. There is no glue in said region, that is to say no glue layer 44 or (PSA) adhesive of the opening aid 18. The gripping or actuating tab 24 is situated here.

For forming the closure tab 20 and/or opening lugs 35, separation cuts or separation lines are applied in the region of the opening aid 18 to be produced, preferably in the material which is finished with regard to the layers 42, 43, 44, 45. The separation lines, which are applied purely in the region of one layer, are preferably produced by laser and, as a result, are restricted to the relevant layer with regard to effectiveness.

The outer contour of the closure tab 20 consists of a preferably continuous, that is to say uninterrupted, substantially U-shaped cutting line 47 (only) in the region of the outer layer, that is to say of the outside individual layer of material 42. Said cutting line extends with preferably approximately parallel legs in the region of the inner end wall 17 (at least in part) and a connecting, end-face region of the inner front wall 13. In the case of the exemplary embodiment in FIG. 13, the cutting line 47 extends with an end piece in the region of the inner rear wall 14. A transversely directed leg extends in the inner front wall 13 and defines the actuating tab 24. The cutting line 47 determines the outer contour of the closure tab 20.

The inside individual layer of material 43 forms the removal opening 19 as a result of removing the opening lug which is formed by the inside individual layer of material 43 and is connected in the present example to the closure tab 20, preferably by means of the correspondingly arranged glue layer 44. The contour of the opening lug 35 is determined by a tear line 48 which is preferably also approximately U-shaped and is defined by applying corresponding technologies (laser) to the inside individual layer of material 43 (including the thin barrier layer 45). The tear line 48 can be realized as a perforation—with residual connections—, preferably however as a continuous cutting line. In the present case, the arrangement made is such that the ends of the cutting line 47, on the one hand, and of the tear line 48, on the other hand, end adjacent one another—in the region of the inner rear wall 14.

The glue pattern of the opening aid 18, that is to say the U-shaped glue pattern with longitudinal strips 21 and transverse strips 22, is realized in the described manner (FIG. 5) with regard to the glue strength. The glue strips 21, 22 are dimensioned such that the cutting line 47 and the tear line 48—the latter completely—are located in the region of the glue pattern 21, 22, naturally with the exception of the contour for the actuating tab 24. The glue field produced preferably from PSA adhesive, as can be seen in FIG. 13 and FIG. 14, is slightly wider than the distance between the cutting lines 47 and tear lines 48 such that the separation lines are covered by the releasable adhesive in said region.

The opening aid realized in this manner can be actuated by hand (by grasping the actuating tab 24). In the case of the present example, the actuating tab 24 is connected in the manner described to the inside of the lid 27 of an outer pack 25 which is realized as a hinge-lid box such that automatic opening and closing is ensured. As can be seen in particular from FIG. 12, the (multi-layered) material is completely detached from the bond during the opening operation in the region of the removal opening 19 to be produced.

Figure 8:
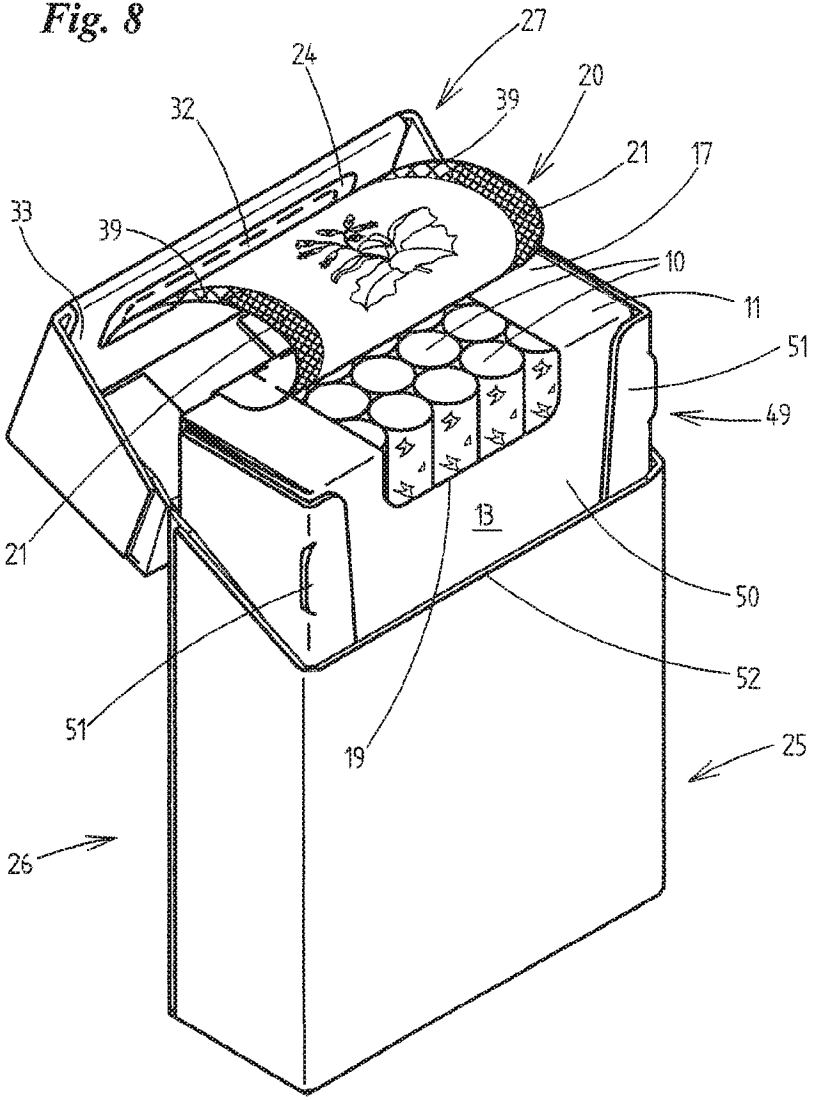
FIG. 8 shows a perspective representation of a (cigarette) pack with a hinge-lid box in the open position.
Figure 7:
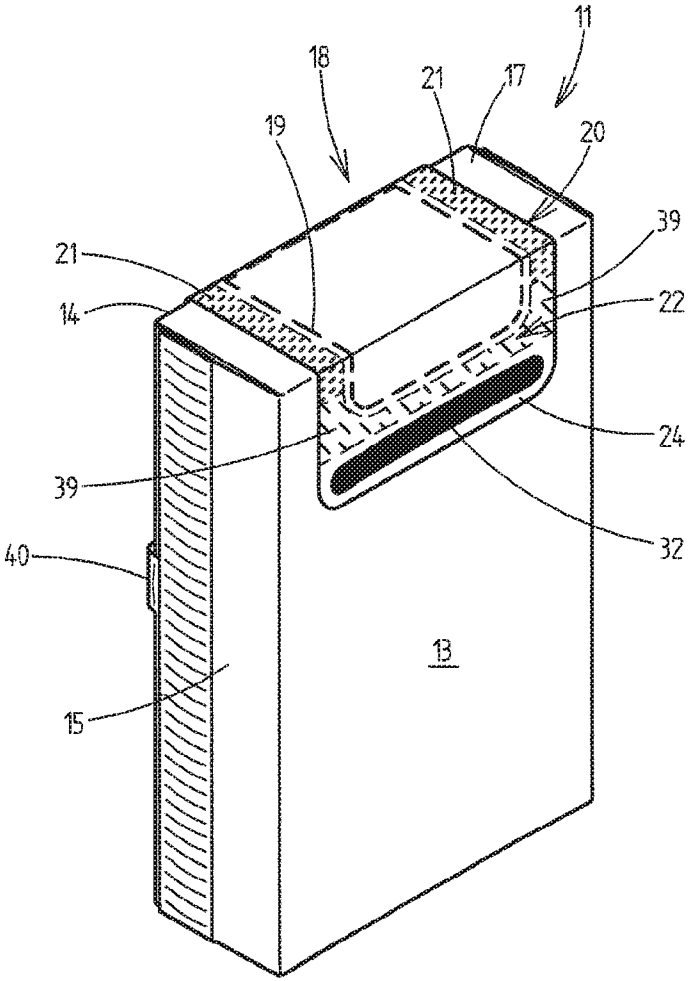
FIG. 7 shows a perspective representation of a cigarette (sealing) block of another embodiment.
Figure 9:
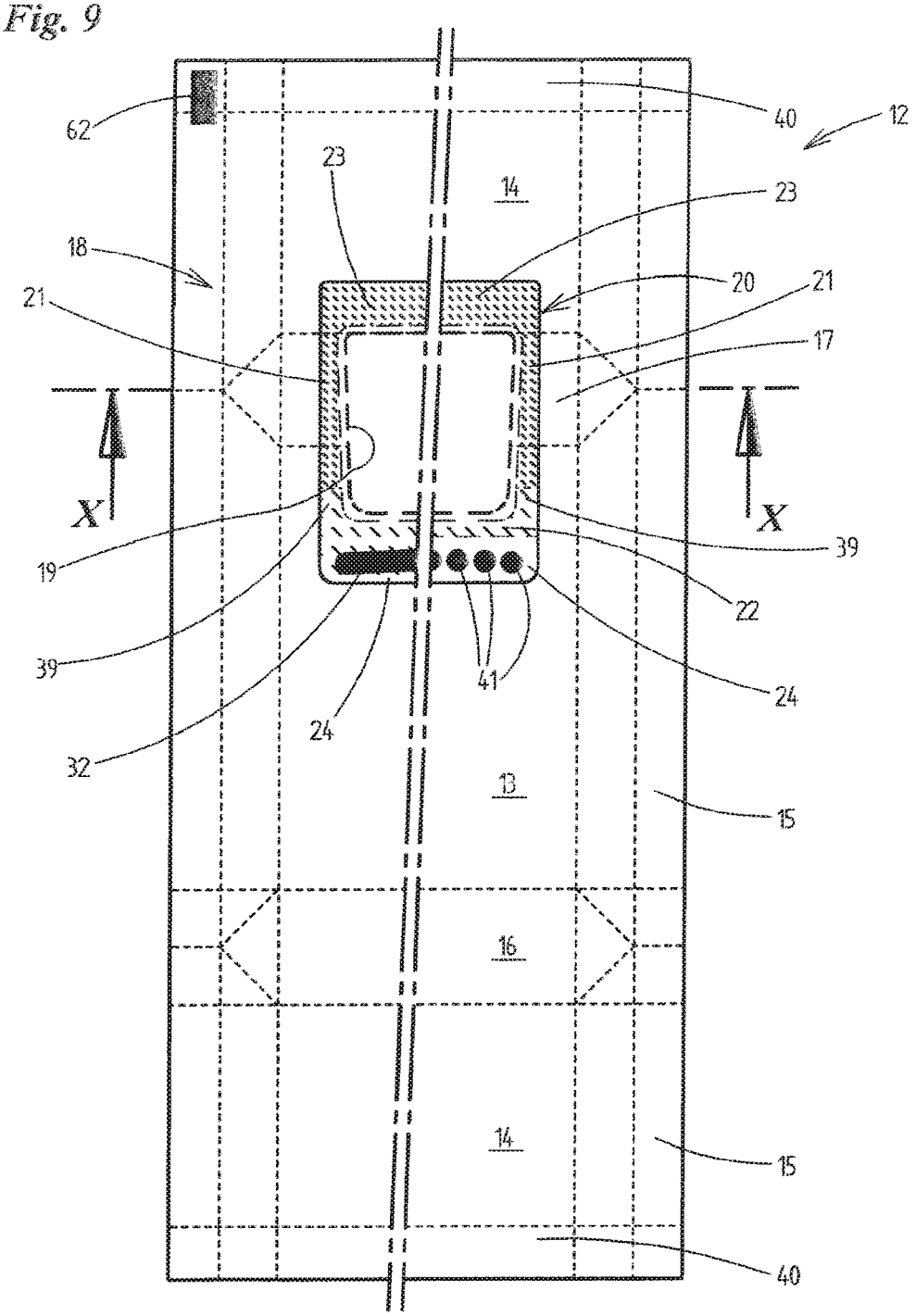
FIG. 9 shows a blank for an inner pack or a sealing block in the realization according to FIG. 7.
Figure 10:
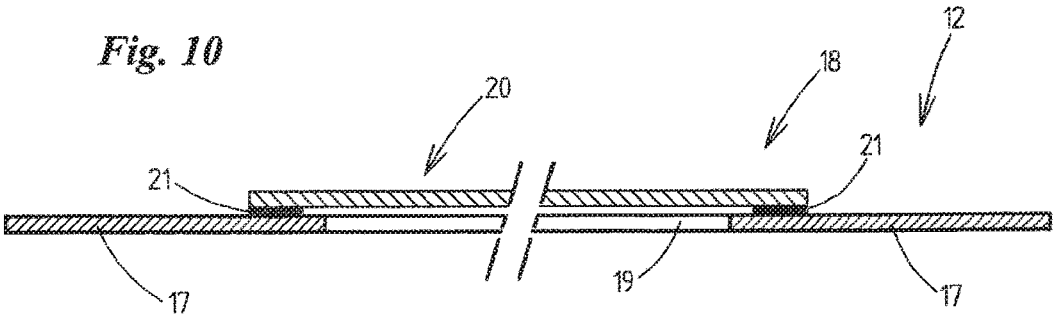
FIG. 10 shows a cross section X-X of the blank according to FIG. 9, in an enlarged scale.

The outer packs 25 are preferably realized as hard packs, in particular as hinge-lid boxes. They can be without a collar, as an alternative to this, however, they can also be provided with a conventional collar 49 (FIG. 8). The collar is provided with a front-side recess 50 which is defined in the region of the front side by side collar webs 51. The recess 50 is preferably realized—between the collar webs 51—such that it extends up to a closing edge 52 of the pack or of the box part 26. The closure tab 20, and in particular the actuating tab 24, is situated—between the collar webs 51—in said region.

In the case of packs where the actuating tab 24 of the opening aid 18 is fixed on the inside of the lid front wall 31, preferably after completion of the pack, a pressing pressure is exerted onto the outside of the lid front wall 31, preferably in the region of an apparatus (in particular the drying turret). The pressure is transmitted in a targeted manner onto the lid front wall 31 by means of a particular pressure piece in the region of the connection to the actuating tab 24—with the lid 27 closed. In the case of a pack with a collar 49, in the region between the collar webs 51. As a result, it is possible, in the case of hinge-lid boxes as an outer pack 25, to use a lid inner lug 33 which extends preferably over the full (transverse) dimension of the lid front wall 31. Certain deformation of the lid front wall 31 is eliminated by the restoring forces of the material once the compressive stress has been removed.

Figure 15:
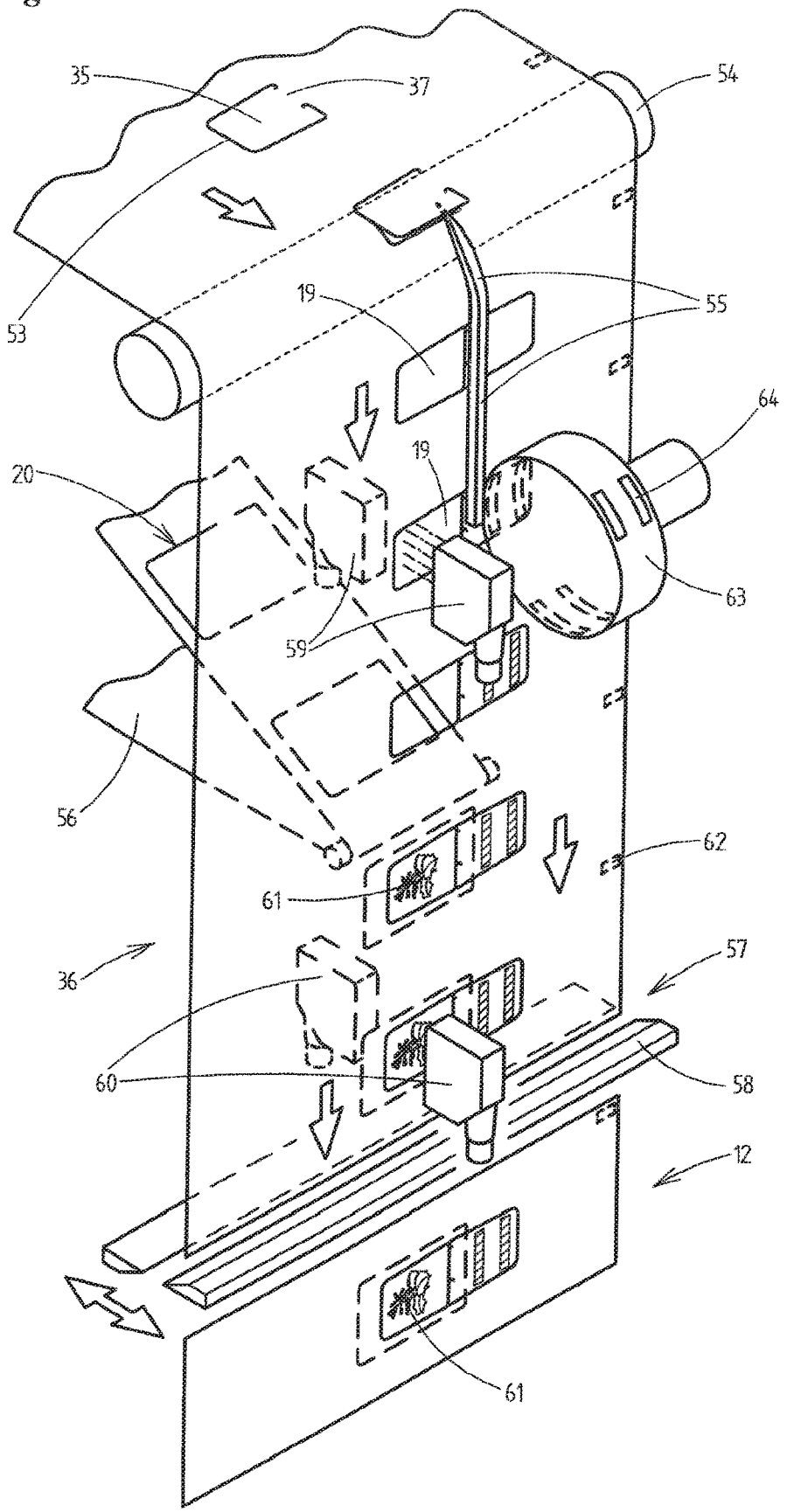
FIG. 15 shows a perspective representation of a detail of a device for producing material webs for the production of blanks according to FIG. 5.
Figure 16:
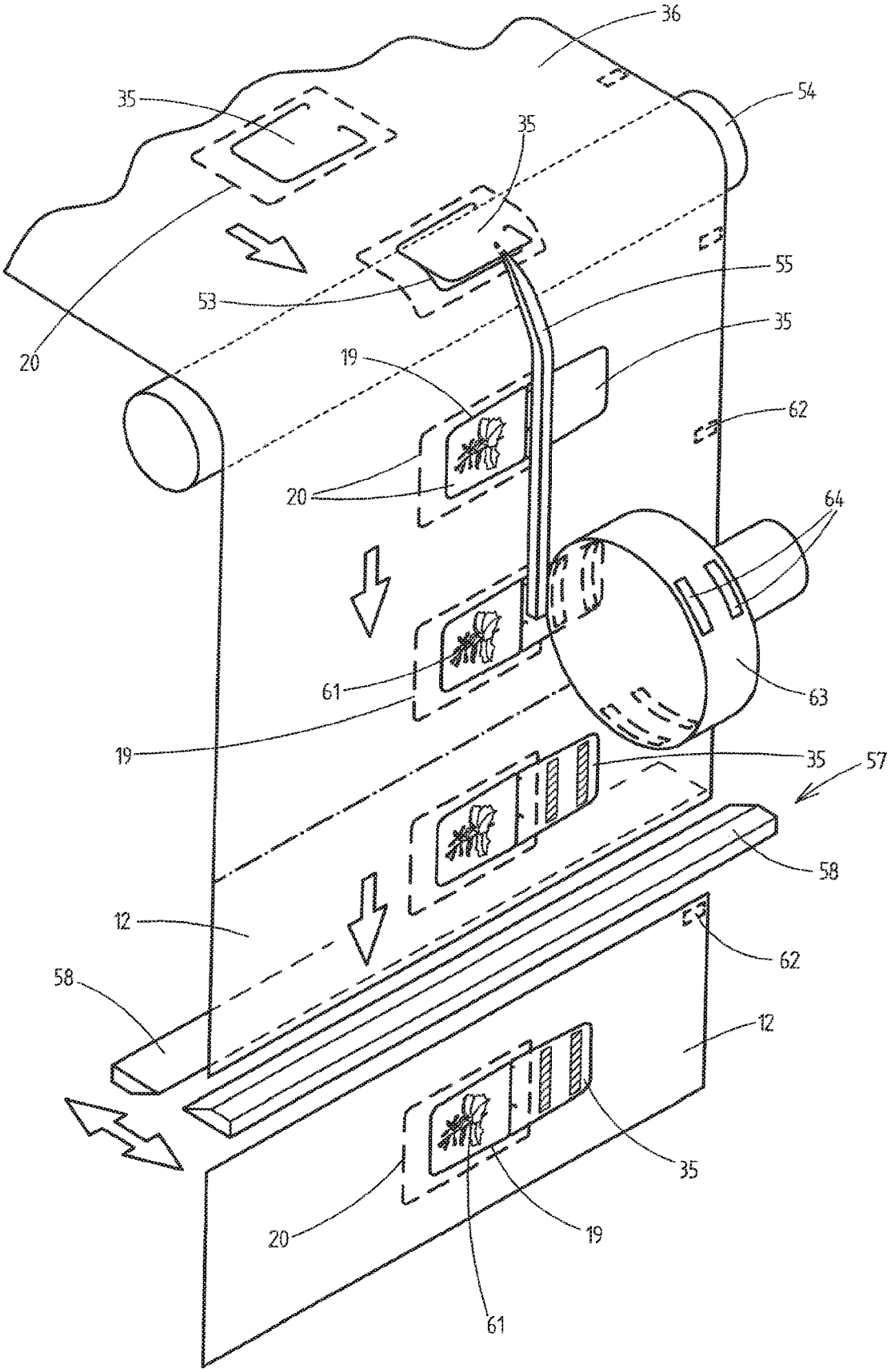
FIG. 16 shows a detail analogous to FIG. 15 with a production alternative.

The opening aid is preferably produced completely in the region of a continuous material web 36. FIG. 15 and FIG. 16 relate to different concepts for an opening aid according to FIG. 4, FIG. 5, that is to say with an opening lug 35 suspended on blank 12. According to FIG. 15, a shortened (residual) connection remains between the lug 35 formed by punching 53 and the material web 36, that is to say a shortened edge 37. The opening lug 35 is gripped, lifted and turned during the transport of the material web 36 until it abuts against the material web 36 outside of the region of the created removal opening 19. To this end, lifting with regard to a front-side edge takes place in the region of a deflection—deflection roller 54. The opening lug 35 can then be gripped by a lifting member, in the present case by a (curved) tapered lifting rail 55. As a result of the transporting of the material web 36, the lug 35 is lifted and finally turned over. As a result, the removal opening 19 is positioned precisely in the region of the material web 36.

The closure tab 20 is then applied onto the material web 36, aligned in a precise manner, in the region of the removal opening 19—in the region of a vertical transport portion of the material web 36. The closure tab 20 is pressed onto the material web 36 as a separate blank from a carrier belt 56 in the region of an acutely angled deflection, on the (outer) side of the material web 36 located opposite the tab 35. The material web 36 then moves into the region of a separation station 57. Here the blanks 12 are cut from the material web 36 one after another by means of transversely directed cutting blades 58. As an alternative to this, the material web 36 can be folded around a sequence of cigarette groups thereby forming a continuous hose-shaped wrapping, from which as a result of cross cutting (in particular in conjunction with a sealing seam) packs—inner pack 11—are cut, in particular in the manner to be found in WO 2014/195016.

A characteristic consists in that the work on the material web 36 and in particular the precise positioning of elements of the opening aid 18 are checked by monitoring members. Thus, sensors, in particular opto-electronic sensors 59, are preferably positioned in the region of the vertical transport section of the material web 36 in the region of a control station. Said sensors 59 are realized such that they detect the presence of the (removal) opening 19, both with regard to the correct relative position and with regard to the correct realization (dimension, contour). Once the sensors 59 have been passed, there is certainty regarding the correct arrangement of the opening 19.

Following the transfer station for the closure tabs 20, a further (fixed) testing station with sensors 60 is installed on both sides of the material web 36. Said (electro-optical) sensors also detect the presence of the closure tab 20 in the correct relative position. The free side of the closure tab 20 is preferably provided with printing 61, namely on the inside of the closure tab 20, with advertising and/or informative references which can be detected by the sensors 60.

The separation cut for producing the blanks 12 is preferably controlled by print marks 62.

The material web 36 also has assigned thereto a sealing member 63 for attaching the sealing strip 38. In the present case, this is a rotatable sealing wheel with multiple parallel sealing jaws 64 which are arranged longitudinally of the periphery. Said member is also able to be controlled, where necessary, by the sensors 59.

The realization according to FIG. 16 differs from the previous exemplary embodiment as a result of the closure tabs 20 already being attached to the material web 36 in a transfer station arranged upstream—in the region of the punching 53 which is applied in particular first of all. The already described operation to lift the opening lug 35 and to turn said lug 35 is then completed. The material web 36 also has assigned thereto, in the case of the exemplary embodiment in FIG. 16, control members (sensors) which test, in particular, the presence and the correct realization of the opening 19 and the presence of the closure tab 20.

Figure 17:
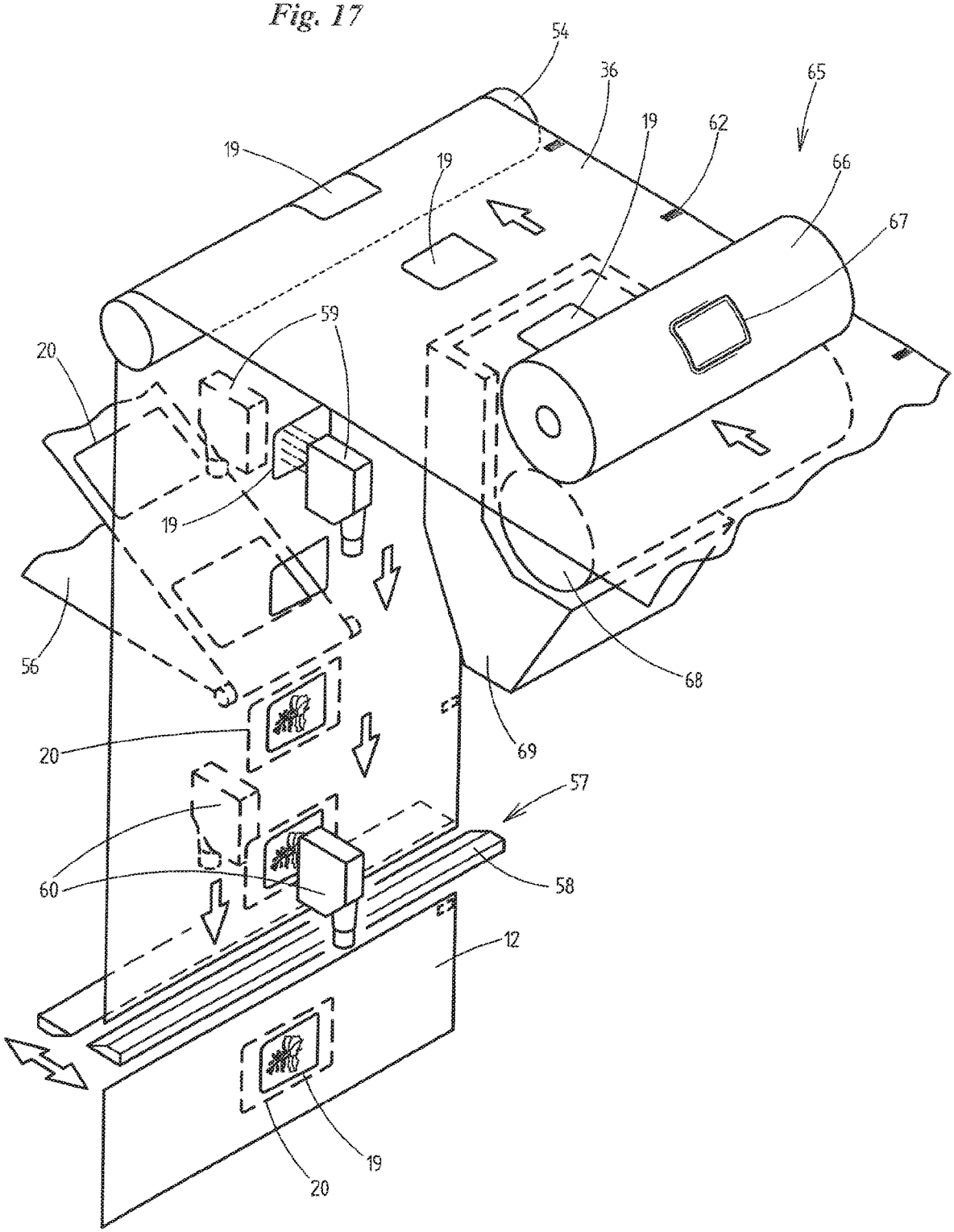
FIG. 17 shows a detail of a production device for blanks with the features of FIG. 4.

The apparatus according to FIG. 17 is designed to remove the opening lug 35 such that a (removal) opening 19 which is free on all sides is generated. A punching unit 65, which in the present case consists of a punching roller 66 with a punching blade 67 and a counter roller 68, is preferably provided for this purpose in the region of a horizontal transport section of the material web 36. The punching blade 67 is realized as a blade which is closed all around, is approximately rectangular and provides a corresponding opening 19 in a precise position in the material web 36.

The material web 36 is then deflected. Testing and control members of the described realization are positioned in the region of a vertical conveying section and also a transfer station for providing the closure tab 20 in the region of the openings 19. The material pieces corresponding to the opening 19 generated in the punching station by the punching unit 65 are removed, in the present case by means of a collecting funnel 69, in particular with a suction effect.

Figure 18:
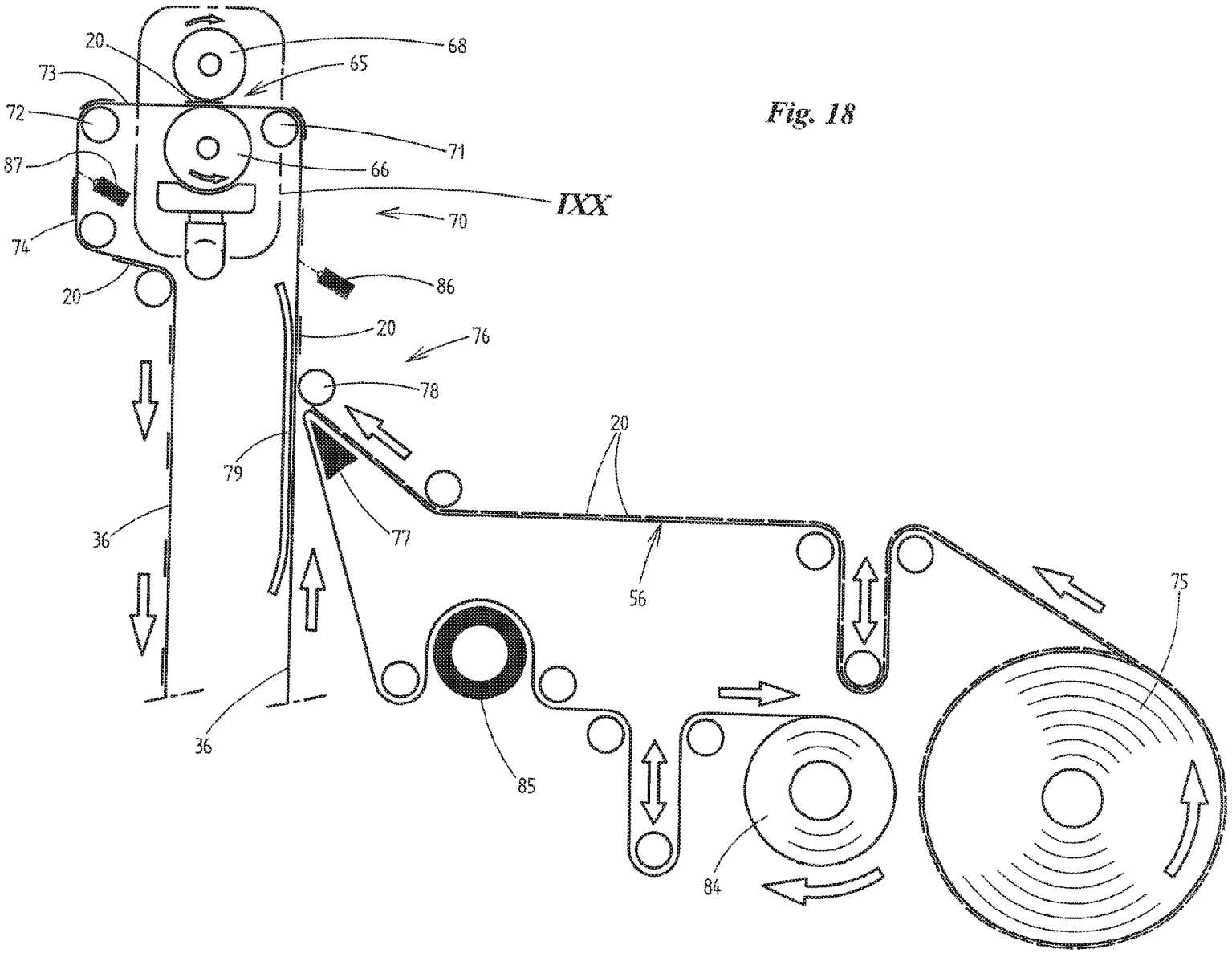
FIG. 18 shows a schematic side view of a further realization of a device for preparing material webs for the inner pack.
Figure 19:
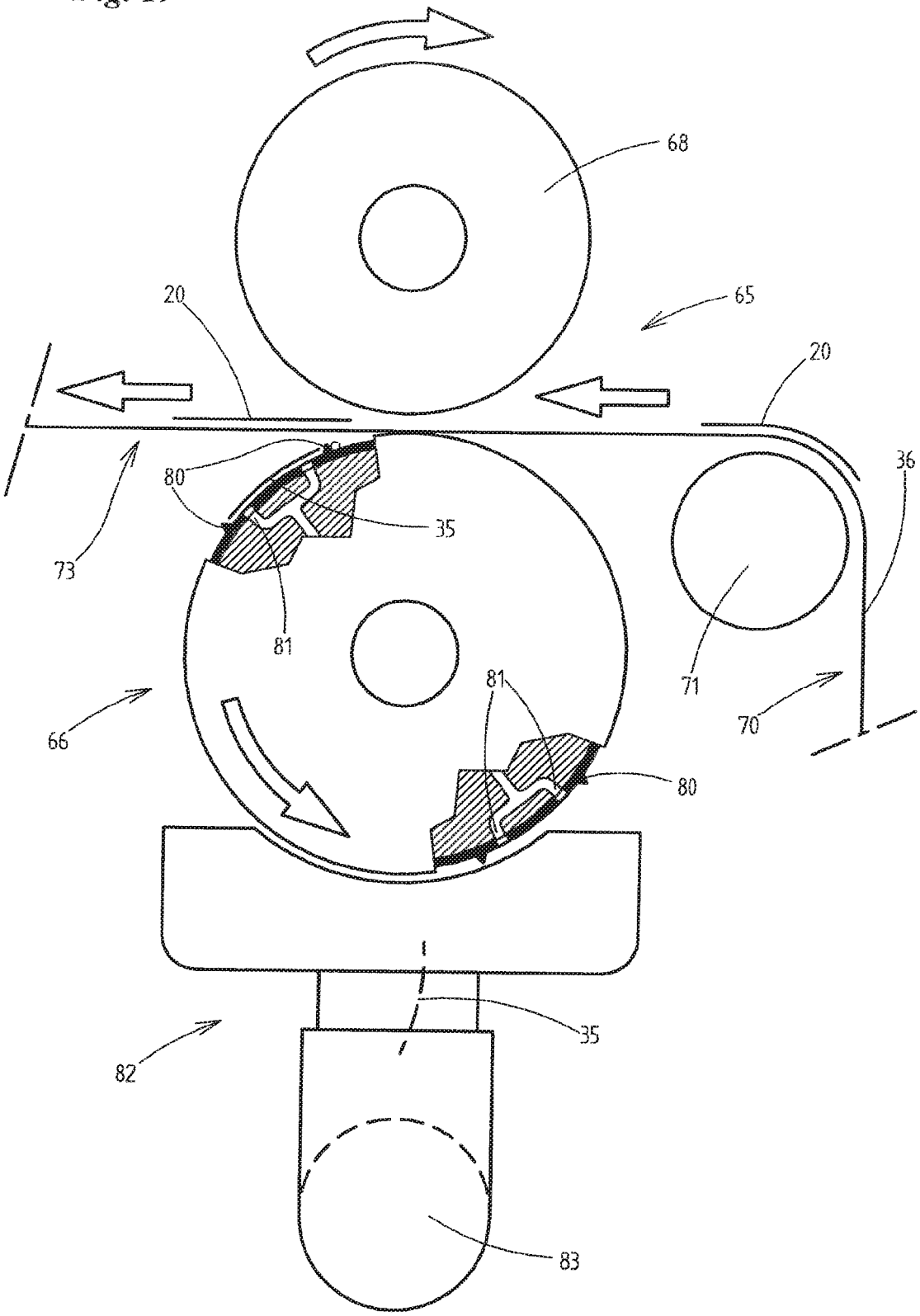
FIG. 19 shows a detail XIX of the apparatus according to FIG. 18 in an enlarged scale.

A particular production technology for the preparation of the material web 36 for producing blanks of the inner packs is shown in FIG. 18 and FIG. 19. The (sealing) material web 36 is preferably moved along upright and transversely directed transport belts. A first (upright) belt portion 70 is provided for an upwardly directed movement of the belt. Said belt is deflected via deflection rollers 71, 72 into a preferably horizontal belt portion 73 and then back into a preferably downwardly directed belt portion 74. The closure tab 20 is preferably fed to the vertical belt portion 70 and placed onto the material web 36 in a manner that suits the pack, preferably on the belt outside or top side. A particular punching unit 65 with a punching roller 66, which preferably acts underneath the (horizontal) material web 36, is preferably situated in the region of the horizontal belt portion 73. A counter roller 68 is mounted above the belt.

The blanks of the closure tabs 20 are preferably arranged side by side on a continuous carrier belt 56. This is removed from a reel 75. The carrier belt 56 is fed to a transfer station 76. In the region thereof, the closure tabs 20 are removed from the carrier belt 56 and transferred to the material web 36 in a precise manner. The carrier belt 56 is guided around an acutely angled deflection member 77 for this purpose, as a result of which the closure tabs 20, adhering in a bonding manner to the carrier belt 56, are peeled off and transferred to the material web 36 which runs at an acute angle to a leg of the carrier belt 56. The closure tab 20 is fixed in the precise position by a pressing roller 78. The pressing roller 78 lies opposite a counter member, in the present case a support plate 79.

In the following punching or cutting station or in the punching unit 65, a preferably closed cutting line is applied, preferably by means of punching, on the free (bottom) side of the material web 36 in the region of the respective closure tab 20, which detaches a material piece—opening lug 35—which corresponds to the opening (removal opening 19). The punching unit 65 is controlled precisely in such a manner that the opening is produced in a precise alignment on the closure tab 20 outside the gluing, as a result of a separation cut exclusively in the region of the material web 36.

The punching roller 66 is provided with preferably multiple, in particular with two punching units, along the circumference, that is to say corresponding groups of punching blades 80. These are preferably realized as closed blade frames for generating a closed cutting line in the material web 36.

The opening lug 35 is removed by suction. The punching roller 66 is preferably provided with suction bores 81 in the region of the punching blades 80. Said (multiple) suction bores are located inside the surface region of the opening lug 35 such that it is fixed on the circumference of the punching roller 66 when a vacuum is applied and is entrained when the said roller rotates. The opening lug 35 is released as a result of venting and can be disposed of.

A particular measure is provided for this purpose: A suction unit 82 is situated on the underside of the punching roller 66 or underneath the same. The suction bores 81 of the punching roller 66 are preferably controlled in such a manner that a switchover to compressed air takes place in the lower region of the rotation. Compressed air is accordingly transferred via the suction bores 81 which results in the opening lug 35 being lifted and transferred to the suction unit 82. Said suction unit takes over the foil piece 35 in a suction channel 83.

The material web 36 prepared in such a manner is fed in the described manner to a separation station for producing the blanks or inner packs.

The carrier belt 56, rid of the closure tabs 20, is returned and taken up by a collecting reel 84. The carrier belt 56 is driven in said region without closure tabs 20 by a driving roller 85. The carrier belt 56 is accordingly pulled over the deflection member 77.

Monitoring or control members are important for correct positioning of the closure tab 20 and/or opening 19 in the preferably continuously driven material web 36. First of all, the positionally precise transfer of the closure tab from the carrier belt 56 to the material web 36 is monitored and controlled by sensors (not shown), preferably in conjunction with print marks on the material web 36. Then, in the case of continued (continuous) transport of the material web 36, a first (opto-electronic) sensor 86 becomes active, preferably in the region of the upright belt portion 17, on the side of the arrangement of the closure tab 20. The sensor 86 is arranged and effective in such a manner that at least a preferably transversely directed edge of the closure tab 20 is detected. This results in a signal for the control of the punching unit 65, namely with regard to a precise application of the cutting line for the production of the opening 19.

A further sensor 87 is effective following the punching unit 65, on the inside of the material web 36—preferably in the region of the downwardly directed belt portion 74—to detect the formed punch-out or opening. Said sensor 87 also detects the presence of the closure tab 20 in a precise relative position with respect to the (removal) opening 19. For this purpose, the free inside of the closure tab 20 is provided with markings and/or colorings which ensure rapid, reliable detection by the sensor 87 in relation to any material web 36 which is shaped in a deviating manner.

LIST OF REFERENCE NUMERALS

10 Cigarette
11 Inner pack
12 Blank
13 Inner front wall
14 Inner rear wall
15 Inner side wall
16 Inner bottom wall
17 Inner end wall
18 Opening aid
19 Removal opening
20 Closure tab
21 Longitudinal strip
22 Transverse strip
23 Anchoring strip
24 Actuating tab
25 Outer pack
26 Box part
27 Lid
28 Box rear wall
29 Lid rear wall
30 Line joint
31 Lid front wall
32 Glue strip
33 Lid inner lug
34 Tray
35 Opening lug
36 Material web
37 Edge
38 Sealing strip
39 Initial leg
40 Cross seam
41 Glue point
42 Outside individual layer
43 Inside individual layer
44 Glue layer
45 Barrier layer
46 Free zone
47 Cutting line
48 Tear line
49 Collar
50 Recess
51 Collar web
52 Closing edge
53 Punching
54 Deflection roller

55 Lifting rail
56 Carrier belt
57 Separation station
58 Cutting blade
59 Sensor
60 Sensor
61 Printing
62 Print mark
63 Sealing member
64 Sealing jaw
65 Punching unit
66 Punching roller
67 Punching blade
68 Counter roller
69 Collecting funnel
70 Belt portion
71 Deflection roller
72 Deflection roller
73 Belt portion
74 Belt portion
75 Reel
76 Transfer station
77 Deflection member
78 Pressing roller
79 Support plate
80 Punching blade
81 Suction bore
82 Suction unit
83 Suction channel
84 Collecting reel
85 Drive roller
86 Sensor
87 Sensor

What is claimed is:

1. A pack for cigarettes (10) or other smoking articles having an outer pack (25), in the form of a hinge-lid pack with a box part (26) and lid (27), and having an inner pack in the form of a sealing block with a blank (12) of material which surrounds a cigarette group, wherein the inner pack (11) comprises an opening aid (18) in an end-face region of an inner front wall (13) of the inner pack (11) and at least in a part of a region of an inner end wall (17), wherein the opening aid (18) comprises a closure means in the form of a closure tab (20) which is produced from a separate blank and which is arranged on the outside of the inner pack (11) and is fastened on the inner pack (11) by means of releasable adhesion and for opening the inner pack (11) is pulled at least in part away from the inner pack (11) and, as a result, exposes a removal opening (19) at least in part, wherein:

the inner pack (11) comprises a removal opening (19) as a free opening, the removal opening (19) being produced during production of the inner pack (11);

b) the closure tab (20) covers the removal opening (19) completely and on all sides in a closed position, with an overlapping edge or overlapping strip (21, 22, 23) which extends all around the removal opening (19);

c) the closure tab (20) is free of adhesives in the region of the removal opening (19), wherein the adhesive-free region of the closure tab (20) is slightly greater than the region of the removal opening (19) and runs all around and surrounds the removal opening (19);

d) the closure tab (20) comprises a glue-free actuating tab (24) in a region adjacent to the inner front wall (13) in the closed position; and e) the means of releasable adhesion are strips of releasable adhesive located on the closure tab (20) in regions directly adjacent to the adhesive-free region of the closure tab (20).

2. The pack as claimed in claim 1, wherein to create the open removal opening (19) a blank (12) or a material web (36) for producing the blank (12) is provided with the removal opening (19), wherein an opening lug (35) is completely removed or remains part of the blank (12) by means of an edge-side connection and as a result of folding over is moved out of the region of the removal opening (19).

3. The pack as claimed in claim 2, wherein the opening lug (35), which is connected to the blank (12), is folded against a wall of the inner pack (11), against an inside of an inner rear wall (14), wherein the opening lug (35) is fixed in the fold position.

4. The pack as claimed in claim 1, wherein the means for releasable adhesion are glue fields applied to the overlapping edge or overlapping strip (21, 22, 23) on the inside of the closure tab (20) for connection of the closure tab (20) to the inner pack (11), and comprise regions of varying intensity or strength of adhesion, in such a manner that, when the closure tab (20) is actuated, the closure tab (20) includes a bonding zone in the form of a transverse strip (22) with a degree of bonding, then a longitudinal strip (21) with a degree of bonding stronger than the degree of bonding of the transverse strip (22), and then an anchoring strip (23) also with a degree of bonding stronger than the degree of bonding of the transverse strip (22).

5. The pack as claimed in claim 1, wherein the closure tab (20) or an actuating tab thereof (24) is connected permanently to the inside of a lid front wall (31) of the outer pack (25).

6. The pack as claimed in claim 5, wherein the closure tab (20) or the actuating tab thereof (24) is connected permanently to the inside of the lid front wall (31) of the outer pack (25) by means of a glue strip (32) and/or glue dots (41) on an outside of the actuating tab (24).

* * * * *